US007997518B2

(12) United States Patent
Hörster et al.

(10) Patent No.: US 7,997,518 B2
(45) Date of Patent: Aug. 16, 2011

(54) ROLLER PRESS WITH RETRACTABLE GRINDING MATERIAL GUIDE METAL SHEET

(75) Inventors: Nils Hörster, Dortmund (DE); Helmut Lücke, Beckum (DE); Silvio Lorenz, Ennigerloh (DE)

(73) Assignee: Polysius AG, Beckum (DE)

( * ) Notice: Subject to any disclaimer, the term of this patent is extended or adjusted under 35 U.S.C. 154(b) by 0 days.

(21) Appl. No.: 12/666,020

(22) PCT Filed: Jun. 16, 2008

(86) PCT No.: PCT/EP2008/057560

§ 371 (c)(1),
(2), (4) Date: Dec. 22, 2009

(87) PCT Pub. No.: WO2009/007196

PCT Pub. Date: Jan. 15, 2009

(65) Prior Publication Data

US 2010/0176234 A1 Jul. 15, 2010

(30) Foreign Application Priority Data

Jul. 10, 2007 (DE) ..... 10 2007 032 177

(51) Int. Cl.
*B02C 18/16* (2006.01)

(52) U.S. Cl. ..... 241/226

(58) Field of Classification Search ..... 241/225, 241/226, 235, 236

See application file for complete search history.

(56) References Cited

U.S. PATENT DOCUMENTS

| | | | |
|---|---|---|---|
| 912,810 | A | 2/1909 | Carleton |
| 3,985,488 | A | 10/1976 | Hoffmann |
| 4,838,494 | A | 6/1989 | Jakobs |

FOREIGN PATENT DOCUMENTS

| | | | |
|---|---|---|---|
| DE | 2456251 | B1 | 5/1976 |
| DE | 3705051 | A1 | 9/1988 |
| JP | 2006043529 | A | 2/2006 |

*Primary Examiner* — Mark Rosenbaum

(74) *Attorney, Agent, or Firm* — Gifford, Krass, Sprinkle, Anderson & Citkowski, P.C.

(57) ABSTRACT

The invention relates to a material bed roller mill having two rollers (1, 2) which are rotatably supported in a machine frame (3) and driven in opposite directions and whose roller gap, which is charged from above with the grinding material to be comminuted, is delimited at its ends during the operation of the roller mill by a grinding material guide plate (5) which can be removed from its operating position, wherein a) the grinding material guide plate (5) is displaceable in an upward direction and away from the end of the roller gap to such an extent relative to its operating position that the rollers (1, 2) can be removed from the machine frame (3) in the horizontal direction;

b) during that displacement movement, the grinding material guide plate (5) is guided by guide bodies along an arc-shaped guide and c) in the operating position, the grinding material guide plate (5) is supported towards the outside against the forces exerted by the grinding material by support members which are connected pivotably to the grinding material guide plate.

8 Claims, 3 Drawing Sheets

ROLLER PRESS WITH RETRACTABLE GRINDING MATERIAL GUIDE METAL SHEET

The invention relates to a material bed roller mill according to the preamble of claim 1.

Material bed roller mills are generally charged with the grinding material to be comminuted by way of a feed chute. In known embodiments, the grinding material guide plate delimiting the roller gap at the end is connected securely to the feed chute.

In order to service material bed roller mills, it is generally necessary to remove the rollers from the machine frame. Since the grinding material guide plate, which is immediately adjacent to the end of the roller gap and which extends downwards approximately as far as the height of the roller axes, obstructs that removal of the rollers from the machine frame, it is necessary, in the case of a grinding material feed plate connected securely to the feed chute, first of all to dismount the feed chute to such an extent that it can be raised to a sufficient degree. As a rule, this also makes it necessary to displace the feed hopper which charges the feed chute. This laborious dismounting and the later re-mounting which has to be carried out when servicing is complete, therefore involve considerable effort.

Furthermore, U.S. Pat. No. 912,810 A discloses a roller mill in which the two grinding material guide plates provided at the ends of the feed chute are connected by connecting plates to form a frame which can if necessary be removed in an upward direction.

In addition, DE 37 05 051 A1 discloses a roller mill in which the end plates are arranged on the side walls of the material feed chute to be resiliently flexible in the axial direction of the rollers.

The object of the invention is so to develop a material bed roller mill of the type mentioned in the introduction that the grinding material guide plate is, on the one hand, during operation, reliably supported towards the outside against the forces exerted by the grinding material but can, on the other hand, be removed from its operating position in a well-guided manner, so that a simple removal and re-installation of the rollers is rendered possible.

That object is achieved according to the invention by the characterising features of claim 1.

With the solution according to the invention, the grinding material guide plate is displaceable from its operating position in relation to the feed chute in such a manner that in its new position (assumed above all for servicing purposes), it does not obstruct the removal of the rollers from the machine frame. It is therefore possible to remove and re-install the rollers without a laborious raising of the feed chute being necessary. Since, during its displacement movement, the grinding material guide plate is guided by guide bodies along an arc-shaped guide, security is provided against a possible tilting of the grinding material guide plate. In the operating position, the grinding material guide plate is, on the other hand, supported towards the outside in such a manner that the forces exerted by the grinding material are introduced directly into the machine frame.

Advantageous configurations of the invention are the subject-matter of the subordinate claims and are explained in connection with the description of an embodiment.

IN THE DRAWINGS

Figure 1:
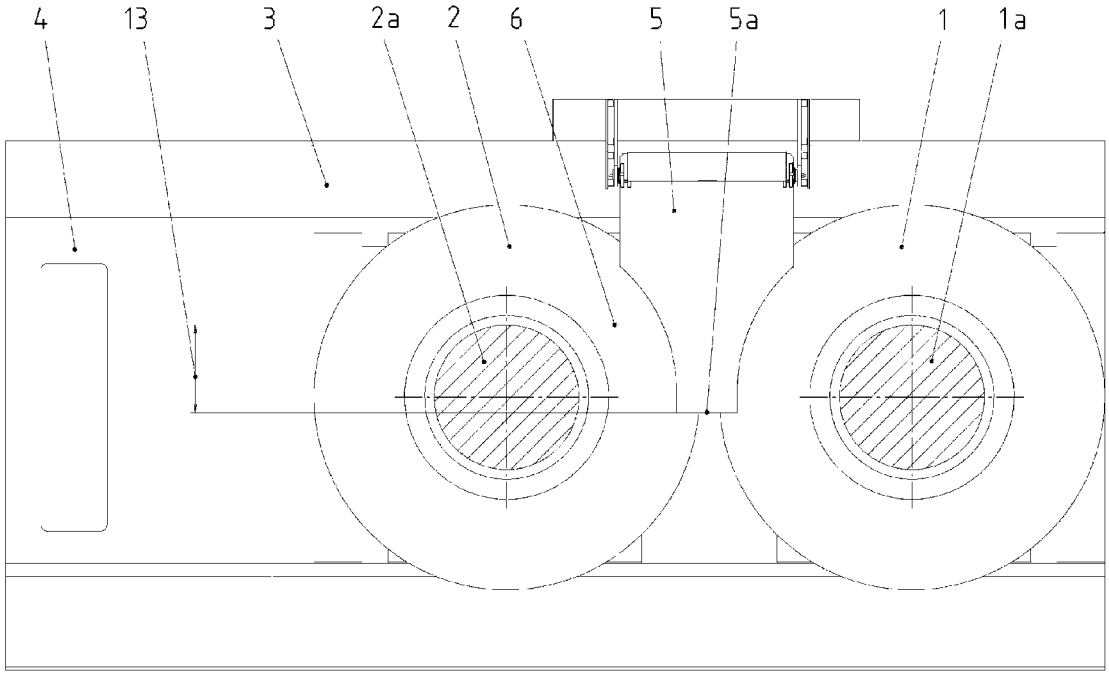
FIG. 1 is a diagrammatic end view of a material bed roller mill.

The material bed roller mill shown diagrammatically in FIG. 1 contains two rollers 1, 2 which are rotatably supported in a machine frame 3 and driven in opposite directions by a drive device (not illustrated). Of those two rollers, the roller 1 is supported as a fixed roller in the machine frame 3, while the roller 2 forms a loose roller which is pushed by a pressure beam 4 in the direction towards the fixed roller 1 and thus generates the high grinding pressure prevailing in the roller gap between the two rollers 1, 2.

The grinding material to be comminuted is conveyed to the roller gap between the two rollers 1, 2 by a feed chute which is arranged above the material bed roller mill and which is not shown in FIG. 1. At each of its two ends, the roller gap is delimited towards the outside by a respective grinding material guide plate 5 during the operation of the mill. There is only a small distance (of, for example, 5 mm) between that grinding material guide plate 5 and the adjacent end of the roller 1 and 2, respectively.

As shown in FIG. 1, the grinding material guide plate 5 extends to just below the narrowest point of the roller gap. The lower edge 5*a* of the grinding material guide plate 5 is therefore located clearly below the upper surface 6 of the shafts 1*a*, 2*a* of the rollers 1, 2.

For servicing, the rollers 1, 2 have to be removed from the machine frame 3 in the horizontal direction. For that purpose, the machine frame 3 is generally opened on the side where the fixed roller 1 is arranged (in the view of FIG. 1, therefore, on the right-hand side). It can be seen from FIG. 1, however, that the grinding material guide plate 5 located in the operating position obstructs removal of the loose roller 2 towards the right.

According to the invention, the grinding material guide plate 5 can be displaced with respect to its operating position to such an extent that the roller 2 can also be removed from the machine frame 3. FIGS. 2 to 5 show the main details of the holding and guiding of the grinding material guide plate 5.

The grinding material guide plate 5 is held displaceably in a guide housing 7 which is for its part connected securely to the machine frame 3 (in a manner not shown in detail here).

The guide housing 7 has a U-shaped profile and engages around the grinding material guide plate 5 with its two limbs 7*a*, 7*b* which adjoin a rear wall 7*c*. Provided in each of the limbs 7*a*, 7*b* of the guide housing 7 is a respective approximately quadrantal groove 7*d*, 7*e* which, in the embodiment shown, is closed at its lower, horizontal, end and open at its upper, vertical, end.

Two guide bodies 8, which are provided in the region of the two narrow sides of the grinding material guide plate 5, engage in the grooves 7*d*, 7*e* of the guide housing 7. For that purpose, the grinding material guide plate 5 can be provided with two lateral projections which are angled towards the rear (in the representation of FIGS. 2 to 5) and which carry the guide bodies 8. Those guide bodies 8 are preferably in the form of rolls or pins.

A further displacement guide for the grinding material guide plate 5 is located between the rear wall 7*c* of the guide housing 7 and the rear side of the grinding material guide plate 5. Approximately in its central region, the rear wall 7*c* of the guide housing 7 carries a vertically extending guide member 9 which is in the form of a guide rail and along which guide rolls 10 run.

The guide rolls 10 are carried by a guide bar 11 which is pivotably connected by means of brackets 12 to the main body 5*b* of the grinding material guide plate 5.

Figure 2:
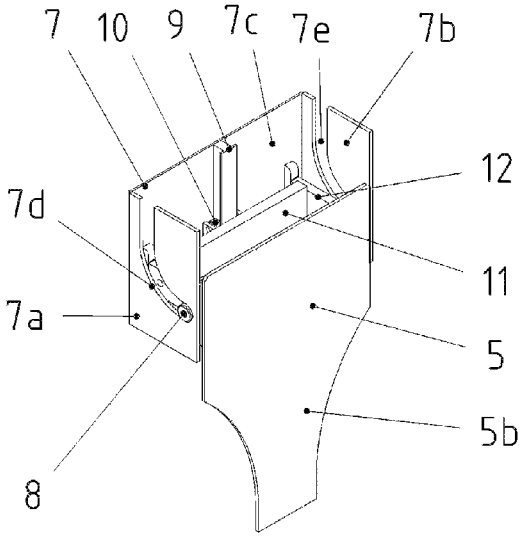
FIGS. 2 to 5 are diagrammatic views of the grinding material guide plate and the guide housing in different positions of the grinding material guide plate.
Figure 3:
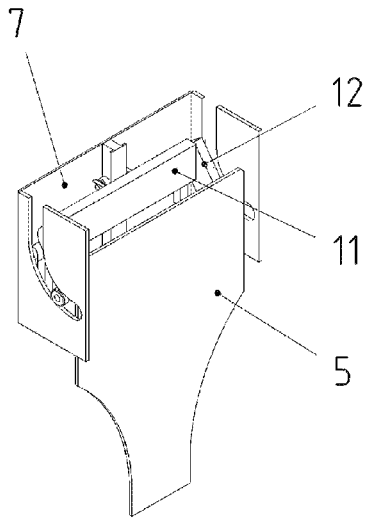

The functioning of the grinding material guide plate 5 according to the invention is therefore as follows: FIGS. 1 and 2 show the operating position in which the grinding material guide plate 5 covers the end of the roller gap between the rollers 1, 2 and thereby prevents the grinding material to be comminuted from escaping from the roller gap under the action of the high grinding pressure. In order to absorb the horizontal forces exerted by the grinding material, the grinding material guide plate 5 is supported on the machine frame 3, on the one hand, in its lower region by an external device (not illustrated in the drawings) and, on the other hand, in its upper region via the brackets 12. In order to produce the latter support, the brackets 12 are so dimensioned that, in the operating position of the grinding material guide plate 5 (FIG. 2), they adopt a horizontal position and abut the rear wall 7*c* of the guide housing 7 directly. Thus, the horizontal forces exerted by the grinding material are, in the upper region of the grinding material guide plate 5, transferred directly, that is to say, bypassing the guide rolls 10, onto the rear wall 7*c* and are therefore introduced into the machine frame 3.

If the rollers 1, 2 are to be removed from the machine frame 3 for servicing, the grinding material guide plate 5 is displaced upwards (at both ends of the rollers) in the guide housing 7 at least by the height measurement 13 (see FIG. 1) relative to its operating position. At the same time, the grinding material guide plate 5 is also moved slightly outwards in the horizontal direction (that is to say, away from the roller gap) in order to avoid components present during the upward movement.

Guided by the grooves 7*d*, 7*e* of the guide housing 7, in which grooves the two lateral guide bodies 8 run, the grinding material guide plate 5 performs an approximately quadrantal movement (see FIG. 3) and finally passes into its upper (and at the same time outer) position (FIG. 4) in which it is freely movable within limits and can if necessary also be pulled out of the guide housing 7 completely. In the upper end position, the grinding material guide plate 5 and the entire unit (including the guide housing 7) are freely accessible and can, if necessary, be replaced.

Figure 4:
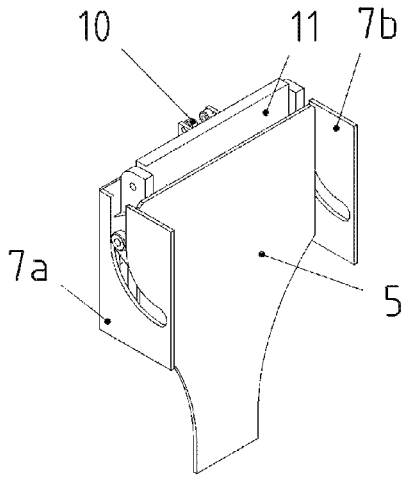
Figure 5:
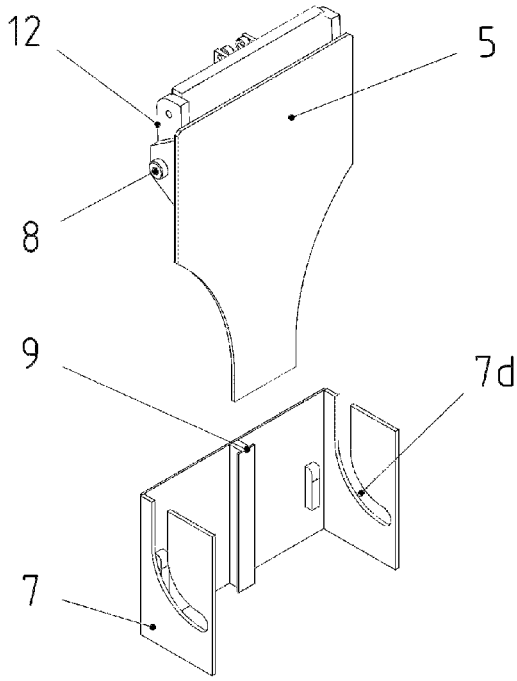

During the described upward and outward movement of the grinding material guide plate 5, the plate is further guided and is especially secured against a possible tilting by the guide rolls 10 running along the guide member 9 of the guide housing 7. The guide bar 11 carrying the guide rolls 10 pivots during this upward movement of the grinding material guide plate 5 about its point of articulation to that plate. While the guide bar 11, in the operating position (FIG. 2), is still in the position folded out horizontally (so that the brackets 12, as mentioned above, abut the rear wall 7*c* directly), it assumes a folded-up position when the grinding material guide plate 5 approaches the upper end of the guide grooves 7*d*, 7*e* (FIG. 4).

A major advantage of the solution according to the invention resides in the fact that, owing to its restricted structural size, it can be readily integrated in already existing material bed roller mills.

The system can be used both in the minerals field and in the cement sector.

The guides used are advantageously provided with excessively wide clearance fits in order to prevent operation being impaired by soiling. The quadrantal guide of the grooves 7*d*, 7*e* can remain open on both sides so that dust deposits can be pushed out towards both sides when the guide is rolled over.

The grinding material guide plate 5 is advantageously moved by a suitable drive. The dead weight of the plate 5 and the rear guide bar 11 will generally not be sufficient to position the system securely in the lower end position.

The guide rolls 10 may advantageously be manufactured from plastics material since they can be more easily replaced when worn than can the guide rail 9 provided on the guide housing 7. At the same time, guide rolls 10 produced from plastics material form a buffer zone which protects other components from excessive wear or even breakage if any tilting of the grinding material guide plate 5 occurs.

The invention claimed is:

1. A material bed roller mill having two rollers (1, 2) which are rotatably supported in a machine frame (3) and driven in opposite directions and whose roller gap, which is charged from above with the grinding material to be comminuted, is delimited at its ends during the operation of the roller mill by a grinding material guide plate (5) which can be removed from its operating position, characterised by the following features:

a) the grinding material guide plate (5) is displaceable in an upward direction and away from the end of the roller gap to such an extent relative to its operating position that the rollers (1, 2) can be removed from the machine frame (3) in the horizontal direction;

b) during that displacement movement, the grinding material guide plate (5) is guided by guide bodies (8) along an arc-shaped guide; and c) in the operating position, the grinding material guide plate (5) is supported towards the outside against the forces exerted by the grinding material by support members which are connected pivotably to the grinding material guide plate.

2. The material bed roller mill according to claim 1, characterised in that the grinding material guide plate (5) is connected to a guide housing (7) which holds the grinding material guide plate in the operating position and has the arc-shaped guide for the displacement of the grinding material guide plate out of the operating position.

3. The material bed roller mill according to claim 2, characterised in that the guide housing (7) has a U-shaped profile and the limbs (7*a*, 7*b*) of the U which engage around the grinding material guide plate (5) contain a quadrantal guide groove (7*d*, 7*e*), the grinding material guide plate having, in the region of each of its two narrow sides, a respective guide body (8) in the form of a roll or pin and which is in engagement with the adjacent guide groove (7*d*, 7*e*).

4. The material bed roller mill according to claim 3, characterised in that the guide housing (7) has in the central region of its rear wall (7*c*), a further guide member (9) for a tilt-free displacement of the grinding material guide plate (5) in the upward direction.

5. The material bed roller mill according to claim 4, characterised in that the further guide member provided on the rear wall (7*c*) of the guide housing (7) is formed by a vertical guide rail (9) made from plastic and with which guide rolls (10) of the grinding material guide plate (5) are in engagement.

6. The material bed roller mill according to claim 5, characterised in that the guide rolls (10) in engagement with the vertical guide rail (9) are carried by a guide bar (11) which is connected pivotably to the main body (5*b*) of the grinding material guide plate (5) by means of the support members supporting the grinding material guide plate in the operating position.

7. The material bed roller mill according to claim 6, characterised in that, in the operating position, the upper region of the grinding material guide plate (5) is supported directly on the rear wall (7*c*) of the guide housing (7) by means of the support members under the action of horizontal forces of the grinding material.

8. The material bed roller mill according to claim 1, characterised in that the support members are realized by brackets (12).

* * * * *